United States Patent [19]

Bergerioux et al.

[11] Patent Number: 4,569,512

[45] Date of Patent: Feb. 11, 1986

[54] DEVICE FOR DESTACKING LETTERS ASSOCIATED WITH A STORAGE MAGAZINE AND SORTING MACHINE EQUIPPED WITH SUCH A DEVICE

[75] Inventors: Jean-Marcel Bergerioux, Preles; Roland Allio, Luzarches, both of France

[73] Assignee: Hotchkiss-Brandt Sogeme H.B.S., Paris, France

[21] Appl. No.: 536,500

[22] Filed: Sep. 28, 1983

[30] Foreign Application Priority Data

Oct. 1, 1982 [FR] France ..... 82 16548

[51] Int. Cl.[4] ..... B65H 3/08

[52] U.S. Cl. ..... 271/103; 209/900; 271/108

[58] Field of Search ..... 209/538, 542, 702, 900; 271/11, 12, 90, 102, 103, 107, 108, 99

[56] References Cited

U.S. PATENT DOCUMENTS

| | | | |
|---|---|---|---|
| 2,028,306 | 1/1936 | Weibel et al. | 271/107 |
| 2,722,416 | 11/1955 | Backhouse | 271/108 |
| 2,792,218 | 5/1957 | Van Marle | 271/5 |
| 2,819,073 | 1/1958 | Murray | 271/11 |
| 3,201,114 | 8/1965 | Swartz et al. | 271/11 |
| 3,265,383 | 8/1966 | Shute | 271/107 |
| 3,879,031 | 4/1975 | Melehan | 271/11 |

FOREIGN PATENT DOCUMENTS

| | | | |
|---|---|---|---|
| 658662 | 1/1965 | Belgium | 271/12 |
| 63127 | 3/1955 | France . | |

OTHER PUBLICATIONS

French Search Report.

*Primary Examiner*—Randolph A. Reese
*Assistant Examiner*—Donald T. Hajec
*Attorney, Agent, or Firm*—Oblon, Fisher, Spivak, McClelland & Maier

[57] ABSTRACT

Envelope or letter destacking device associated with a storage means. Such a device comprises a nozzle actuated by an orientation device which is able to impart thereto a swinging or rocking movement (arrow $F_b$) and a translational movement (arrow $F_L$). The invention applies to mail sorting machines.

10 Claims, 7 Drawing Figures

DEVICE FOR DESTACKING LETTERS ASSOCIATED WITH A STORAGE MAGAZINE AND SORTING MACHINE EQUIPPED WITH SUCH A DEVICE

BACKGROUND OF THE INVENTION

The present invention relates to a device for destacking letters or envelopes associated with a storage magazine. It also relates to a sorting machine equipped with such a device.

Numerous more or less automatic coding stations controlled by an operator are known. Such machines can be intended either for the indexing (writing data) or for indexing sorting (reading data).

One of the most difficult functions to be carried out in sorting machines is destacking. It is necessary for each envelope or letter to be individually seized and then to be brought to a coding station. It is necessary that the operator can easily understand the information carried by the envelope which must be indexed. Therefore, the envelope must be supplied to the operator in a visible manner during the minimum necessary time and without any risk of double takes.

SUMMARY OF THE INVENTION

The present invention aims at solving all these problems and relates to a device for destacking envelopes or letters associated with a storage magazine. The device includes means for moving the letters up to a stop strip in such a way that each successive letter is taken up by a nozzle having orientation means. Control means ensure that, on the one hand, the nozzle performs a swinging movement and, on the other hand, the nozzle performs a translation movement. The control means comprise a first jack having means for ensuring the swinging movement of the nozzle as soon as the nozzle is closed by the first letter to be destacked.

BRIEF DESCRIPTION OF THE DRAWINGS

The invention is described in greater detail hereinafter relative to non-limitative embodiments and with reference to the attached drawings, wherein.

DESCRIPTION OF THE PREFERRED EMBODIMENT

In order to facilitate understanding, the same elements carry the same references throughout the drawings.

Figure 1:
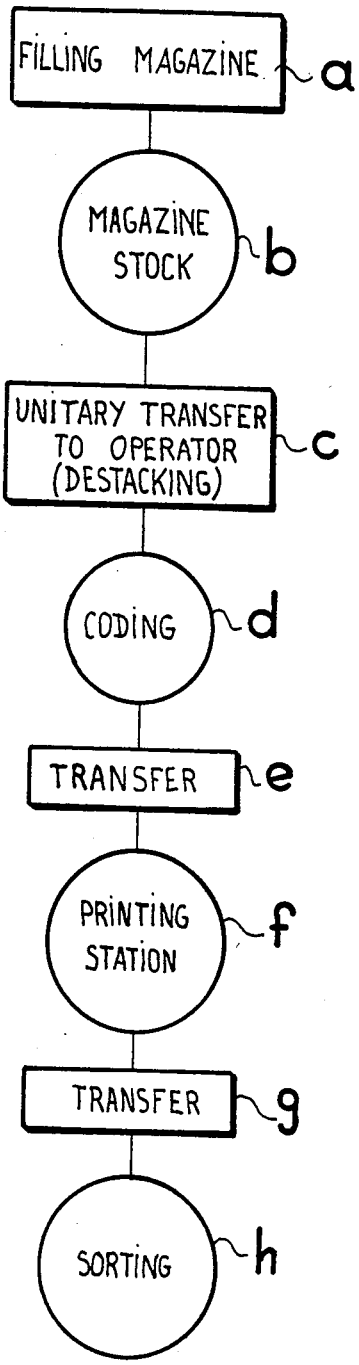
FIG. 1 is a diagram showing the functions of the different elements of the machine.

FIG. 1 is a diagram showing the general architecture of an indexing and sorting machine. The latter generally comprises a combination of the means listed hereinafter. Thus, there are initially means (a) ensuring the filling of the magazine associated with storage means (b). Means (c) carry out the unitary transfer of mail from the storage magazine (b) to the operator for the coding operation at (d). The means (c) are constituted by the destacking means (c). The mail is then transferred by means (e) to the printing station (f). Subsequently, the mail is again transferred by means (g) to the sorting station (h).

Figure 2:
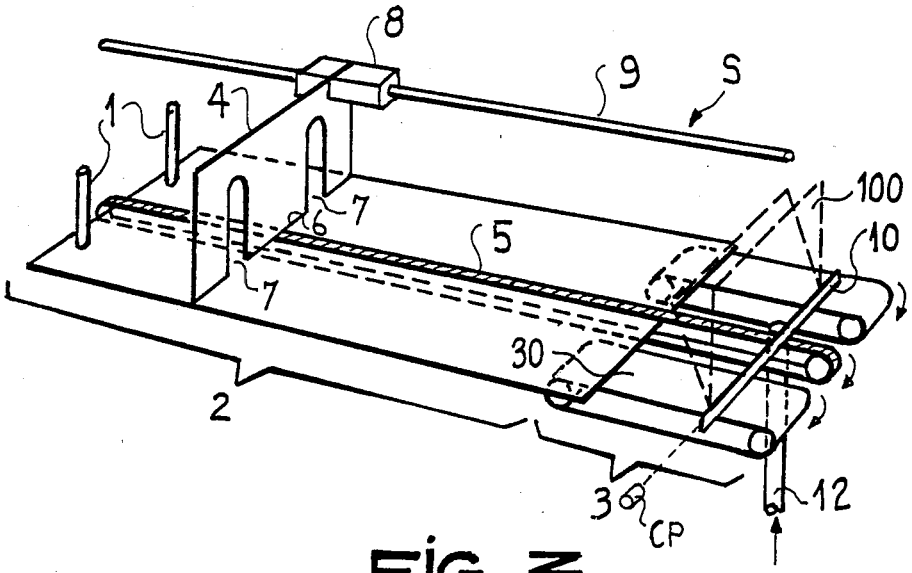
FIG. 2 diagrammatically illustrates an embodiment of the supply magazine.

FIG. 2 is an embodiment of a magazine (S) and illustrates functions (a) and (b) of FIG. 1. The magazine is constituted by a base against which the final letter or envelope stored hears. This base is constituted by two vertical fingers 1 and the actual base surface. The actual base surface is constituted by two separate areas namely, an area 2 representing a static friction surface and an area 3 formed by a motorized belt 30 which brings the letters to the destacking area by moving their bases. This base surface has a slope aiding the presentation of the letters to the destacking means.

Magazine (S) is also constituted by a letter moving plate 4 which exerts a pressure action on the letters. The plate 4 is moved by a motorized chain 5 carrying a lug 6 which bears against the plate 4. Moreover, the plate 4 has two cutouts 7 which, by cooperating with fingers 1, make it possible to easily position the plate 4 to the rear of the stack during reloading. Finally, the plate 4 is guided by means 8 connected to a cylindrical rod 9. This connection permits a rotary movement of the plate 4 about the axis of the rod 9. This movement of the plate 4 permits the lug 6 on the chain 5 to be retracted, as well as the return from a frontal or intermediate position, along area 2, to a rear position, to the rear of the two fingers 1.

The front part of magazine (S) comprises a stop strip 10 against which the base of the first envelope or letter is applied. Photoelectric cells (e.g., CP), detect the presence of letters abutting against strip 10 and, if there are no letters, control the advance of chain 5.

The strip 10 is dimensioned in such a way as to effectively cooperate with the destacking means, as well as optionally with blowing means 12, which exercise a certain buckling or folding action, thereby facilitating separation.

Figure 3:
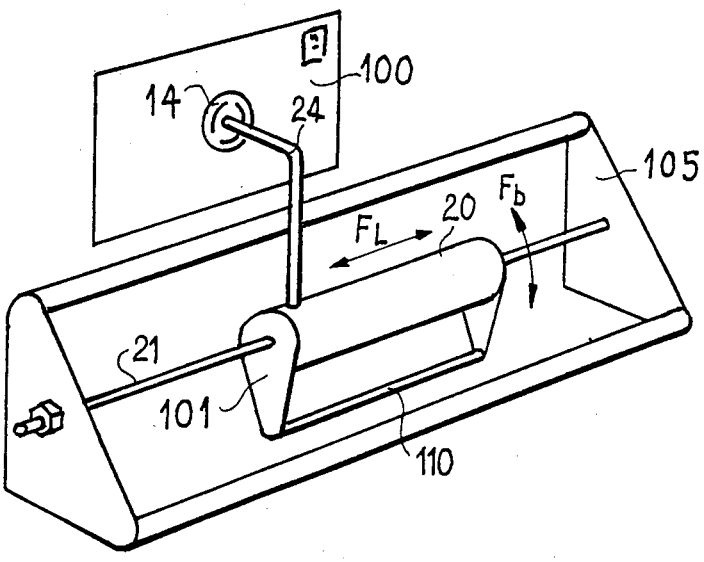
FIGS. 3 and 4 diagrammatically show the presently preferred embodiment of the destacking means (function (c) of FIG. 1) according to the present invention in perspective and in side view, respectively.
Figure 4:
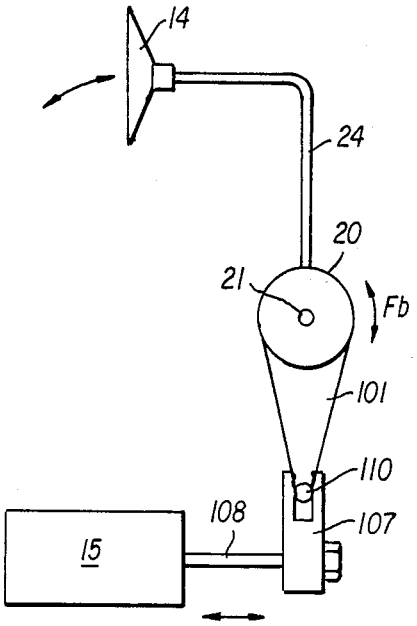

As shown in FIGS. 3 and 4, a letter 100 is sucked in by means of a nozzle 14, which is integral with orientation means 101. The orientation means 101 is equipped with first and second means able to ensure a rocking or swinging movement symbolized by arrow $F_b$ and a translation movement symbolized by arrow $F_L$. The first and second means are supported by a frame 105. The orientation means 101 are connected to control means 106 via a fork 107 which cooperates with a connecting spindle 110.

Figure 5:
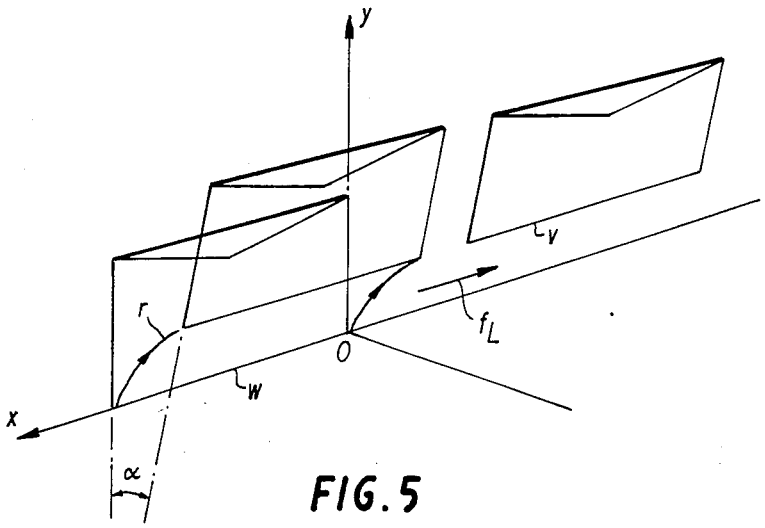
FIG. 5 is a diagram illustrating the kinematics used in the invention.

When using as the starting reference for the envelope or letter the plane xoy in FIG. 5, the destacking means moves the letter into an intermediate position, such that the letter forms an angle $\alpha$ with the original plane and the level (v) of the base of the letter is slightly larger than the upstream movement level (level w). This change of planes is obtained by a simple rotation (r). The letter is then displaced towards the reading position in the manner indicated by arrow $F_L$.

Figure 6:
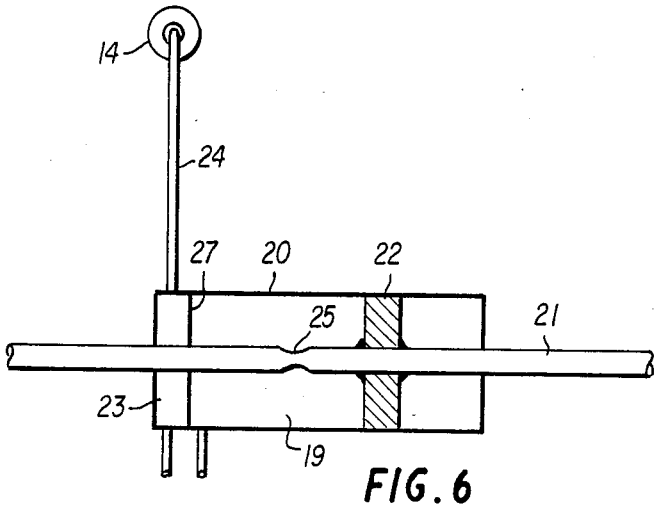
FIGS. 6 and 7 illustrate means for regulating the operation of the destacking device shown in FIGS. 3 and 4.
Figure 7:
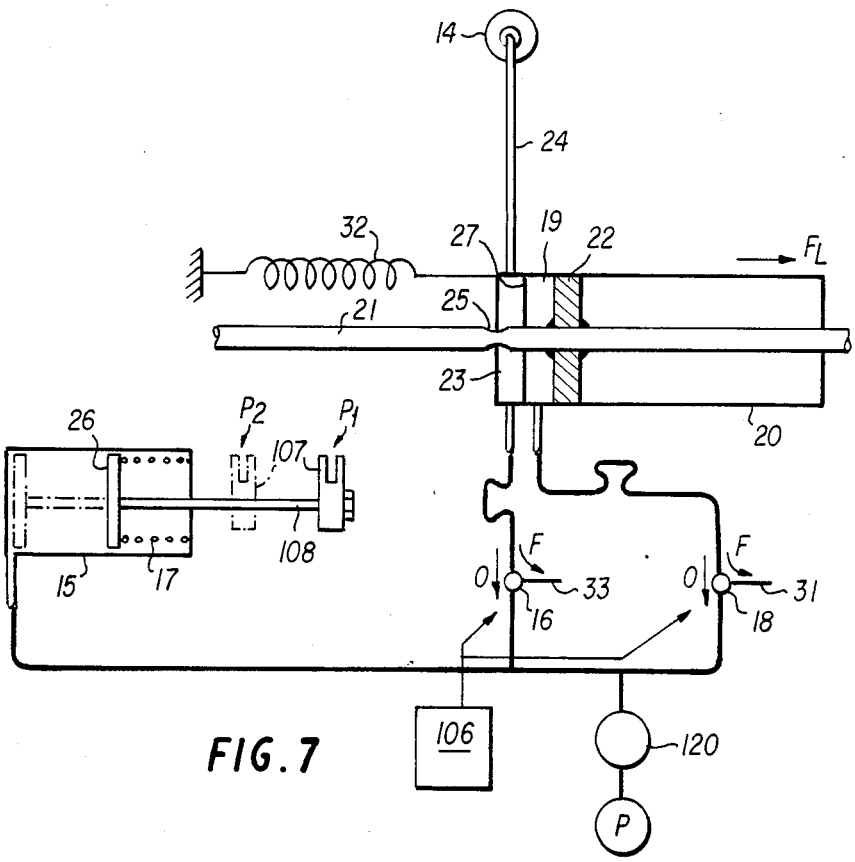

As is shown in FIGS. 6 and 7, jack 15 is connected to a tank 120 which can be placed under vacuum. The jack 15 contains a movable piston 26 which divides the interior of the jack 15 into two chambers. The piston 26 is connected to a rod 108 which, in turn, is connected to the fork 107. The fork 107 is itself fixed to the spindle 110, and the fork 107 can move between a first position $P_1$ (shown in solid line form) and a second position $P_2$ (shown in broken line form). The return movement of the rod 108 of jack 15 is ensured by a return spring 17 located in the right-hand chamber in the jack 15. The return spring 17 is a tension spring—that is, it biases the rod 108 toward the right in FIG. 7.

Pumping means P, which produce a vacuum, are connected to tank 120. The tank 120 is connected to the nozzle 14 via a first valve 16 and to the jack 15. At time TO, the valve 16 is closed, the nozzle 14 is in the vertical position (i.e., the fork 107 occupies the position $P_2$ and the jack 15 is under vacuum. When the valve 16 is closed, the nozzle 14 is not subject to the suction action caused by the pumping means. Under the action of the return spring 17, the opening of the valve 16 causes the fork 107 to move from the vertical position $P_2$ to the position $P_1$, which corresponds to the application of the nozzle 14 against the first letter in the stack to be destacked. As soon as a letter covers the nozzle 14, the left-hand chamber of the jack 15 is automatically placed under vacuum again, and air pressure in the right-hand chamber in the jack 15 overcomes the action of the return spring 17. This has the effect of bringing the nozzle—letter assembly to the vertical position.

The means which cause the translation movement $F_L$ comprise a jack 20 which has two chambers 19 and 23 separated by a disk 27 fixedly mounted in the jack 20. The body of the jack 20 can slide along a fixed spindle 21. A fixed piston 22 is integral with the spindle 21 and is located within the chamber 19. The chamber 19 is linked with pumping means P via the tank 120 and a second value 18. Placing the chamber 19 under vacuum leads to the rightward translation of the jack 20 along the fixed spindle 21. This movement has the effect of bringing about a translation movement $F_L$ of the letter towards the reading position in the present embodiment. The fixed spindle is also provided with a constriction 25, which constitutes an end-of-travel outlet. That is, when the constriction 25 coincides with the disk 27, air in the chamber 23 enters the chamber 19 through the constriction 25.

For releasing the letter, it is firstly necessary to the close valve 16, which links chamber 23 with the open air via an outlet 33 of the valve 16, chamber 23 being linked with the nozzle 14 by a pipe 24. Secondly, the constriction 25 is positioned in such a way that the breaks of the seal of the chamber 23 takes place at the end of the travel corresponding to the letter release zone.

When the jack 20 reaches the end of the rightwards travel, the valve 18 is closed. An outlet 31 to the open air of valve 18 then links the chamber 19 of the jack 20 with the open air, and a return spring 32 moves jack 20 leftwards. The letters then bear against the stop strip 10 facing the operator. As described hereinbefore, the nozzle 14 takes up the first letter which appears. As a result of its double movement, namely rotary on the one hand and linear on the other, it seizes the envelope and presents it to the operator, who reads the code written thereon and types it on a keyboard provided for this purpose. The envelope is then moved to a code recording means, before being taken up by a device performing the conventional transfer function and is then again sorted.

In order to improve the coding rates, the device can be equipped with at least two magazines, in such a way that the operator can firstly read a first letter (e.g., the right hand letter) and strike the keyboard. At the same time, he can anticipate the reading of the code on a second letter (e.g., the left-hand letter).

What is claimed is:

1. A device for destacking envelopes or letters, said device comprising:

(a) a suction nozzle which, during use of the device, is applied to and holds successive envelopes or letters while each successive envelope or letter is conveyed from a first location to a second location;

(b) a fixed spindle;

(c) a piston fixedly mounted on said fixed spindle;

(d) a first jack slidably and pivotably mounted on said fixed spindle, said first jack containing a first chamber and a second chamber, said first and second chambers being separated by a disk fixedly mounted in said first jack and said second chamber being bounded axially by said disk and said piston;

(e) a pipe which is attached to said suction nozzle and to said first jack such that linear and pivotal motion of said first jack causes corresponding linear and pivotal motion of said suction nozzle, said pipe providing a path of fluid communication between said suction nozzle and said first chamber;

(f) a second jack having a rod which is operatively connected to said first jack such that linear motion of said rod causes pivotal motion of said first jack;

(g) a vacuum pump;

(h) first conduit means for communicating vacuum from said vacuum pump to said first chamber;

(i) second conduit means for communicating vacuum from said vacuum pump to said second chamber; and (j) third conduit means for communicating vacuum from said vacuum to said second jack, whereby:

(k) when vacuum from said vacuum pump is suppplied to said suction nozzle through said pipe, said first chamber, and said first conduit means, air pressure will hold an envelope or letter against said suction nozzle;

(l) when vacuum from said vacuum pump is supplied to said second chamber through said second conduit means, said first jack slides linearly along said fixed spindle; and (m) when vacuum from said vacuum pump is supplied to said second jack through said third conduit means, said rod causes said first jack to pivot around said fixed spindle.

2. A device as recited in claim 1 wherein said second jack is operatively connected to said first jack by means of:

(a) a lever arm extending radially from said first jack;

(b) a spindle mounted on said lever arm and extending in parallel to said fixed spindle; and (c) a fork which is mounted on said rod and which slidably and pivotably accepts said spindle, whereby linear motion of said rod causes said spindle to both slide and pivot in said fork, the component of motion of said spindle parallel to the motion of said rod causes said lever arm to pivot, and the pivotal motion of said lever arm causes said first jack to pivot about said fixed spindle.

3. A device as recited in claim 1 and further comprising a first return spring biasing said first jack in the direction opposite to the direction in which it is caused to move when vacuum from said vacuum pump is supplied to said second chamber.

4. A device as recited in claim 1 and further comprising a second return spring biasing said rod in the direction opposite to the direction in which it is caused to move when vacuum from said vacuum pump is supplied to said second jack.

5. A device as recited in claim 1 wherein:

(a) said fixed spindle passes through said first and second chambers and (b) said fixed spindle has a constriction therein which comes into register with said disk at one end of the travel of said first jack, thereby providing a path of fluid communication between said first and second chambers.

6. A device as recited in claim 5 wherein, when said constriction comes into register with said disk, air pressure in said first chamber is communicated to said second chamber.

7. A device as recited in claim 1 and further comprising a first valve located in said first conduit means which, in a first position, selectively communicates a vacuum from said vacuum pump to said first chamber and, in a second position, communicates an ambient pressure to said first chamber.

8. A device as recited in claim 1 and further comprising a second valve located in said second conduit means which, in a first position, selectively communicates a vacuum from said vacuum pump to said second chamber and, in a second position, communicates an ambient pressure to said second chamber.

9. A device for destacking envelopes comprising:

(a) a storage hopper for envelopes in an approximately horizontal stack, said storage hopper being equipped with means for carrying the envelopes up to a stop blade;

(b) a suction means for grasping an envelope, said suction means being mounted on a support and placed vertically in a rest position opposite the envelope;

(c) pumping means;

(d) a first connection pipe equipped with a first controllable valve connecting said suction means to said pumping means;

(e) a first pneumatic means connected to said pumping means, said first pneumatic means having a piston pulled elastically in one direction and being coupled to said support for the rocking of said suction means towards the envelope and for the return of said suction means to its rest position by control of said first controllable valve;

(f) a shaft;

(g) a fixed piston mounted on said shaft;

(h) a second connection pipe equipped with a second controllable valve connecting said pumping means to a second chamber to be recited; and (i) a second pneumatic means mounted to slide along said shaft, said second pneumatic means comprising:

(i) a first chamber interposed in said first connection pipe between said first controllable valve and said suction means and (ii) a second chamber delimited by said fixed piston and connected to said second pipe for the translation of said suction means by control of said second controllable valve.

10. A destacking device as recited in claim 9 and further comprising, on said shaft, a means for breaking the airtightness of said first chamber in order to define the end of the translation travel of said second pneumatic means.

* * * * *